US011725359B2

(12) United States Patent
Lim

(10) Patent No.: US 11,725,359 B2
(45) Date of Patent: Aug. 15, 2023

(54) VIBRO-HAMMER HAVING SIDE GRIP

(71) Applicant: STERLING TECHNOLOGY INC., Hwaseong-si (KR)

(72) Inventor: Wan Bin Lim, Seoul (KR)

(73) Assignee: Sterling Technology Inc., Hwaseong-si (KR)

( * ) Notice: Subject to any disclaimer, the term of this patent is extended or adjusted under 35 U.S.C. 154(b) by 397 days.

(21) Appl. No.: 17/251,388

(22) PCT Filed: Nov. 30, 2020

(86) PCT No.: PCT/KR2020/017223
§ 371 (c)(1),
(2) Date: Dec. 11, 2020

(87) PCT Pub. No.: WO2022/114312
PCT Pub. Date: Jun. 2, 2022

(65) Prior Publication Data

US 2022/0349145 A1 Nov. 3, 2022

(30) Foreign Application Priority Data

Nov. 27, 2020 (KR) ..... 10-2020-0163084

(51) Int. Cl.
*E02D 7/18* (2006.01)

(52) U.S. Cl.
CPC ..... *E02D 7/18* (2013.01)

(58) Field of Classification Search
CPC combination set(s) only.
See application file for complete search history.

(56) References Cited

U.S. PATENT DOCUMENTS

2015/0275460 A1* 10/2015 Audet ..... E02D 7/18 173/38
2018/0195248 A1* 7/2018 Ozkan ..... F16F 15/08

FOREIGN PATENT DOCUMENTS

| | | | |
|---|---|---|---|
| JP | 07-102561 | A | 4/1995 |
| JP | 8198580 | A | 8/1996 |
| KR | 10-0962081 | B1 | 6/2010 |
| KR | 10-1472251 | B1 | 12/2014 |
| KR | 10-2018-0015196 | A | 2/2018 |

OTHER PUBLICATIONS

Office Action dated Jan. 13, 2021 of Korea Patent Application No. 10-2020-0163084 which corresponds to this application.

* cited by examiner

*Primary Examiner* — Kyle Armstrong
(74) *Attorney, Agent, or Firm* — Goldilocks Zone IP Law

(57) ABSTRACT

The present disclosure relates to a vibro-hammer 1 connected to heavy construction equipment, and more particularly, a vibro-hammer 1 having a side grip in which vibrations are prevented from being transmitted to a connected heavy equipment machine to avoid a problem such as a change in a perforation position, the vibro-hammer 1 is firmly connected to a perforated pile to transmit vibrations generated in a gear box to the perforated pile through the side grip and improve workability, arms are gear-coupled to each other to prevent the arms and the side grip from being released from each other due to frequent vibrations, a pair of arms and the side grip can come into close contact with the perforated pile or separated from the performed pile by a single cylinder, the side grip can be easily replaced according a shape of the perforated pile, and applicability and workability is improved.

4 Claims, 16 Drawing Sheets

VIBRO-HAMMER HAVING SIDE GRIP

CROSS-REFERENCE TO RELATED APPLICATIONS

This application claims the benefit under 35 U.S.C. section 371, of PCT International Application No. PCT/KR2020/017223, filed on Nov. 30, 2020, which claims foreign priority to Korean Patent Application No. KR10-2020-0163084, filed on Nov. 27, 2020, in the Korean Intellectual Property Office, both of which are hereby incorporated by reference in their entireties.

BACKGROUND OF THE DISCLOSURE

Field of the Disclosure

The present disclosure relates to a vibro-hammer connected to heavy construction equipment, and more particularly, a vibro-hammer having a side grip in which vibrations are prevented from being transmitted to a connected heavy equipment machine to avoid a problem such as a change in a perforation position, the vibro-hammer is firmly connected to a perforated pile to transmit vibrations generated in a gear box to the perforated pile through the side grip and improve workability, arms are gear-coupled to each other to prevent the arms and the side grip from being released from each other due to frequent vibrations, a pair of arms and the side grip can come into close contact with the perforated pile or separated from the performed pile by a single cylinder, the side grip can be easily replaced according a shape of the perforated pile, and applicability and workability is improved.

Related Art

In general, in order to build all structures such as a building or a bridge on the ground, a foundation work must be performed to embed a concrete pile, a steel pipe pile, and an I-beam so that the ground can withstand the weight of the structure.

In the case of the pile construction, the pipe construction is very important in constructing the structure and the building, and in particular, in the case of soft ground, the foundation work in which a pile is drive and fixed in a bedrock in a basement layer below the ground surface should be carried out, and in the foundation work, an operation of driving a pile into the ground is called a driving operation.

Recently, in the driving operation, a method is mainly used, which vibrates a chuck in a driving direction, that is, in a vertical direction with respect to the pile, using a drive gear and an eccentric weight operated by driving a motor in a state where the pile is fixed through the vibro-hammer. Accordingly, a friction between the pile and the ground is reduced through the vibrations of the pile, and thus, a smooth driving operation is achieved.

Meanwhile, since vibrations generated from a gear device including the motor, the drive gear and the eccentric weight are transmitted not only to the pile but also to the connected heavy equipment machine for construction, there is a concern that the machine is overwhelmed and may cause a breakdown.

In addition, when vibrations are transmitted to a heavy equipment machine, there is a concern that a position is deviated from an initial position at which the driving operation is performed, and in this case, the position of the pile is also changed together. Accordingly, there is a fatal disadvantage that the pile cannot be stably driven into the ground and the foundation work is poor.

SUMMARY OF THE DISCLOSURE

The present disclosure is made to solve the above-described problem, and an object thereof is to provide a vibro-hammer having a side grip which prevents vibrations from being transmitted to a connected heavy equipment machine to avoid a problem such as a change in a perforation position and is firmly connected to a perforated pile to transmit vibrations generated in a gear box to the perforated pile through the side grip and improve workability.

Moreover, an object of the present disclosure is to provide a vibro-hammer having a side grip in which arms are gear-coupled to each other to prevent the arms and the side grip from being released from each other due to frequent vibrations, a pair of arms and the side grip can come into close with the perforated pile or separated from the perforated pile by a single cylinder, the side grip can be easily replaced according a shape of the perforated pile, and applicability and workability are improved.

In addition, an object of the present disclosure is to provide a vibro-hammer having a side grip in which transmission of vibration to a heavy equipment machine is minimized, and upper and lower arms are alternately disposed when the arms are driven to have a good balance.

The problems to be solved by the present disclosure are not limited to the problems mentioned above, and other problems that are not mentioned will be clearly understood by those skilled in the art from the following description.

In order to solve the above-described problems, according to the present disclosure, there is provided a vibro-hammer having a side grip which grips and vibrates a perforated pile, including: a mount portion which is connected to a construction heavy equipment machine; a side clamp portion which houses a gear box generating vibrations and includes a pair of arms and a pair of side grip; a housing bracket which is coupled to the mount portion and the side clamp portion to connect the mount portion and the side clamp portion; and a bottom clamp which is located at a lower end of the side clamp portion to vibrate an upper end of the perforated pile, in which in the side clamp portion, a pair of rotating shaft is respectively provided in an upper portion and a lower portion of the gear box and one end of each of the pair of arms penetrates the rotating shaft to be coupled and rotates about the rotating shaft, one end of the side grip is coupled to the other end of the arm, and the other end of the side grip comes into close contact with or is separated from an outer surface of the perforated pile, and the pair of arms includes a gear arm therein, and when the gear arm is gear-coupled to the arm and one arm is rotated, the other gear-coupled arm is also rotated, and the arm and the side grip is away from each other or close to each other.

Moreover, the pair of arms includes a first arm of which one end is coupled to a cylinder fixed to the side clamp, and a second arm of which the gear arm formed one end meshes with the gear arm provided in the first arm to be gear-coupled to the gear arm, and when the first arm is rotated about the coupled rotating shaft by driving of the cylinder, the second arm is rotated in a direction opposite to the first arm through the gear-coupled gear arm and the first and second arm are away from each other or close to each other.

In this case, the pair of arms is located on an upper side and a lower side of the gear box, and the cylinder is coupled to the arms located on the upper side and the lower side, the cylinder located on the upper side is provided on one side, the cylinder located on the lower side is provided on the lower side, and when the cylinders are driven, the cylinders intersect on a vertical line.

Moreover, the side grip includes a close-contact portion which comes into close contact with an outer surface of the perforated pile when the perforated pile is gripped and has a plurality of protrusions on a close contact surface, and the pair of side grips is close to each other or away from each other according to a rotation of the arm, and the close-contact portion comes into close contact with or separated from the outer surface of the perforated pile.

In this case, the close-contact portion includes a rotation portion which protrudes from a surface opposite to a close-contact surface which comes into close contact with the perforated pile, and the other end of the side grip includes a rotation portion moving groove into which the rotation portion is introduced and rotated and a close-contact portion rotating shaft which vertically penetrates the rotation portion introduced into the rotation portion moving groove and couples the side grip and the rotation portion to each other, and the close-contact portion rotates in a tangential direction with respect to the outer surface of the perforated pile about the close-contact portion rotating shaft and grips the perforated pile.

Moreover, a ball bearing is provided on the outer surface of the close-contact portion rotating shaft penetrating the side grip.

In addition, the vibro-hammer further includes an auxiliary engagement portion which protrudes in a front direction from a front surface of the side grip and has an engagement groove recessed from a side surface having the close-contact portion, in which when the close-contact portion grips the perforated pile, an end portion of the perforated pile is introduced into the engagement groove to fix the perforated pile.

Moreover, the housing bracket is provided to be separated from a side surface of the side clamp portion, a plurality of anti-vibration rubbers are further provided in a separate space between the housing bracket and the side clamp portion, and anti-vibration rubber brackets are provided on both side ends of the anti-vibration rubber, the anti-vibration rubber bracket is coupled to an inner surface of the housing bracket and the outer surface of the side clamp portion so that the side clamp portion is fixed to be separated from the housing bracket inside the housing bracket.

DESCRIPTION OF EXEMPLARY EMBODIMENTS

Figure 1:
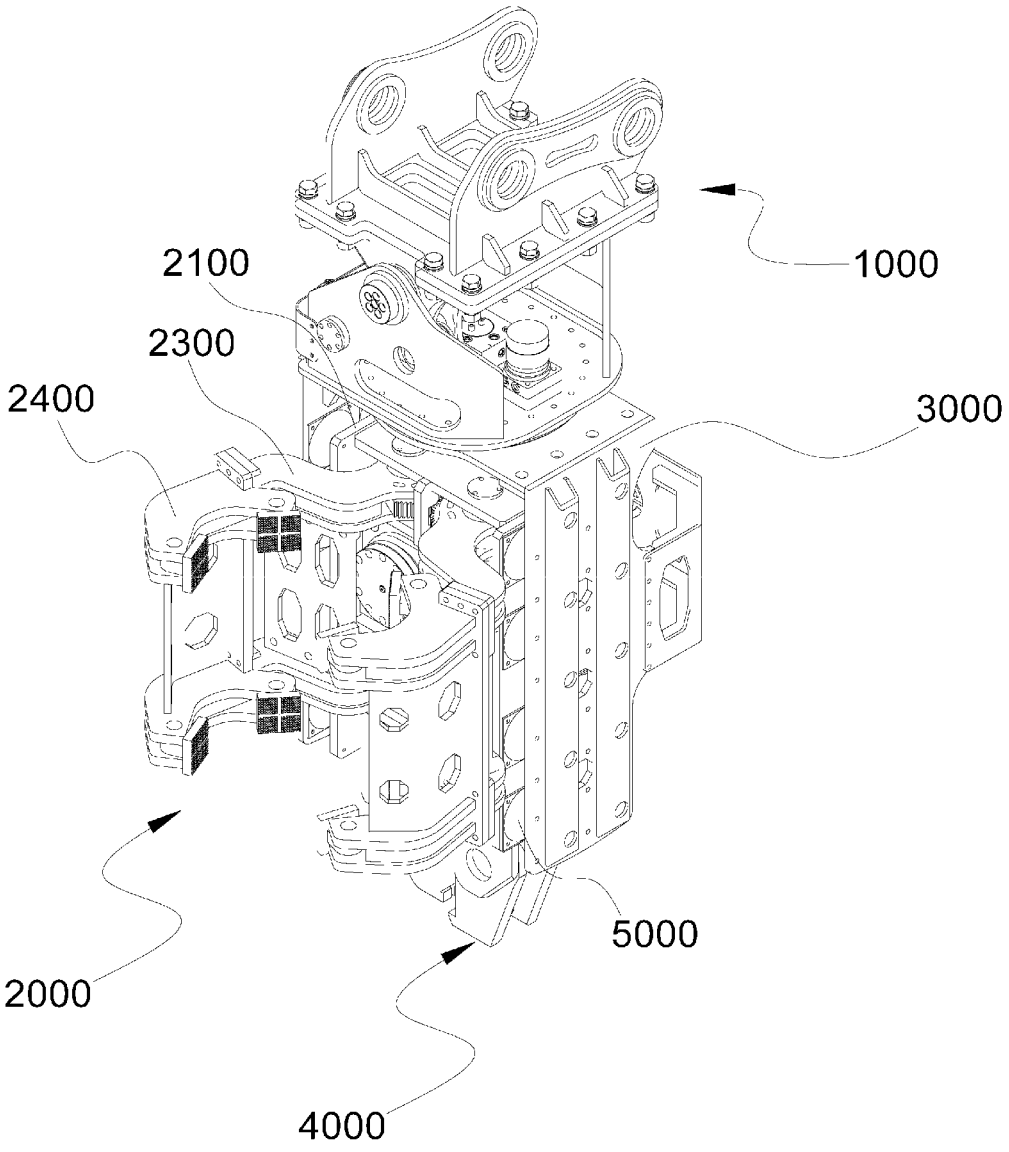
FIG. 1 is a perspective view illustrating a configuration of a vibro-hammer having a side grip according to the present disclosure.

The present disclosure may have various modifications and embodiments, and specific embodiments will be described in detail with reference to the drawings.

However, this is not intended to limit the present disclosure to the specific embodiments, and it is to be understood as including all modifications, equivalents, or substitutes included in the spirit and scope of the present disclosure. In describing each drawing, similar reference numerals have been used for similar elements.

When a component is referred to as being "coupled" or "connected" to other components, it is understood that the component may be directly coupled or connected to other components, but a component may exist between the component and other components. On the other hand, when a component is referred to as being "directly coupled" or "directly connected" to other components, it should be understood that there is no other component therebetween.

A terminology used in the present application is used to describe a specific embodiment, and is not intended to limit the present disclosure. As used herein, a singular form may include a plural form unless the context clearly indicates otherwise. Moreover, in the present application, terms such as "comprise" or "have" are intended to designate the presence of features, numbers, steps, actions, components, parts, or combinations thereof described in the specification. That is, it is to be understood that the presence or addition of one or more other features, numbers, steps, actions, components, parts, or combinations thereof is not precluded in advance.

Hereinafter, embodiments of the present disclosure will be described with reference to the accompanying drawings. Hereinafter, embodiments of the present disclosure will be described with reference to the accompanying drawings. In describing the present disclosure, detailed descriptions of related known functions or configurations are omitted in order not to obscure the subject matter of the present disclosure.

Figure 2:
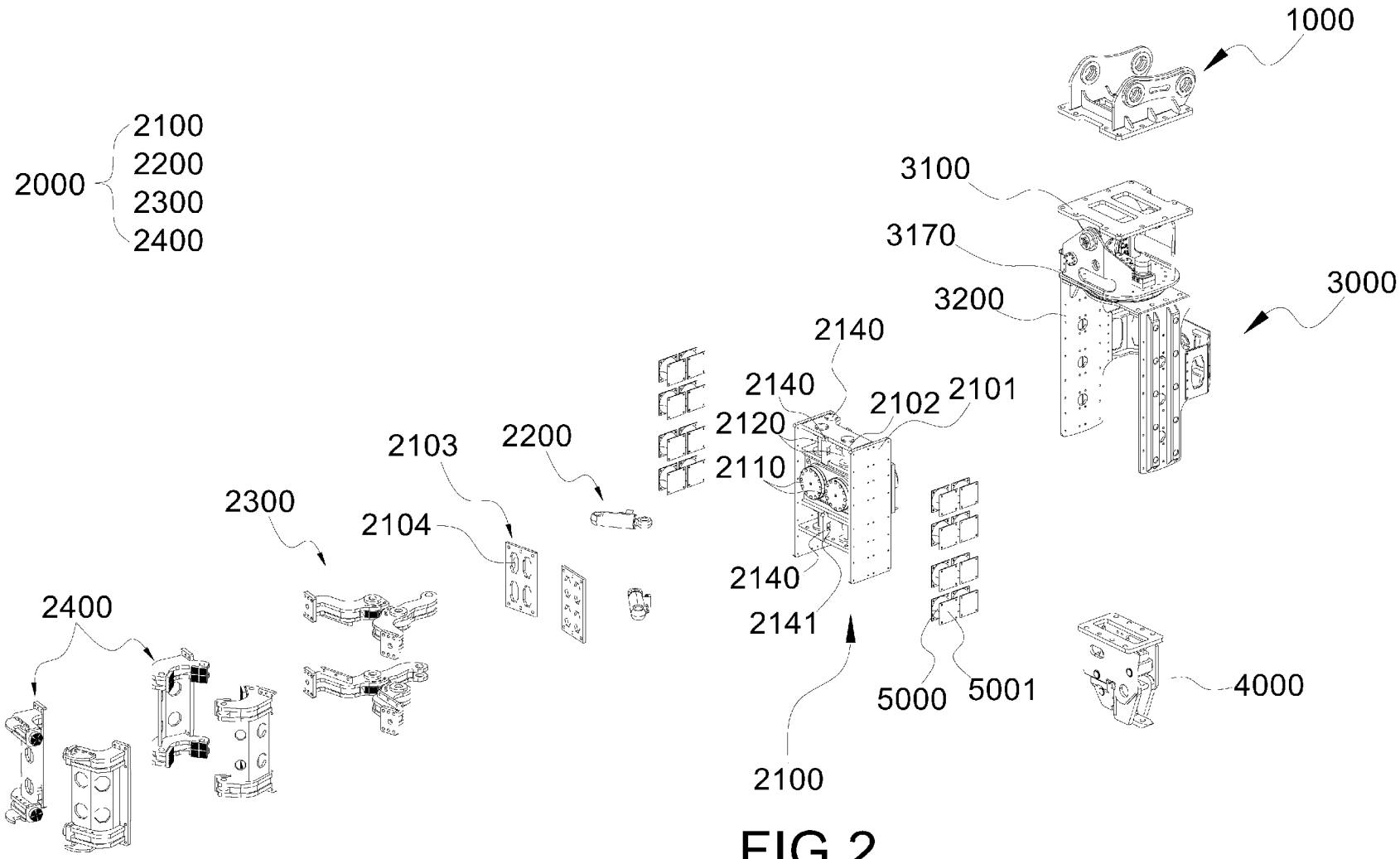
FIG. 2 is an exploded perspective view illustrating the vibro-hammer having a side grip according to the present disclosure.
Figure 2A:
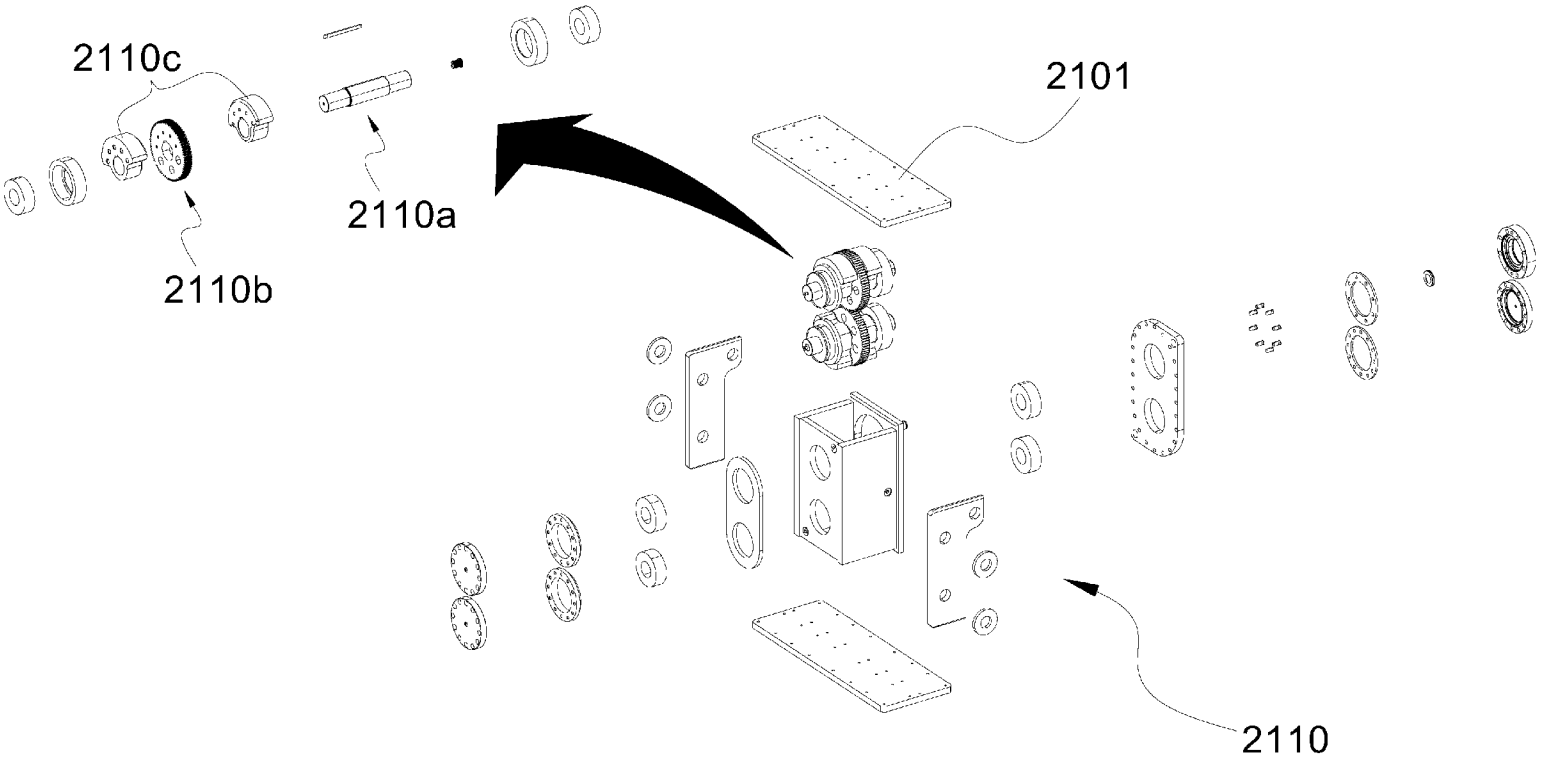
FIG. 2A is an exploded perspective view illustrating an internal configuration of a gear box module according to the present disclosure.
Figure 2B:
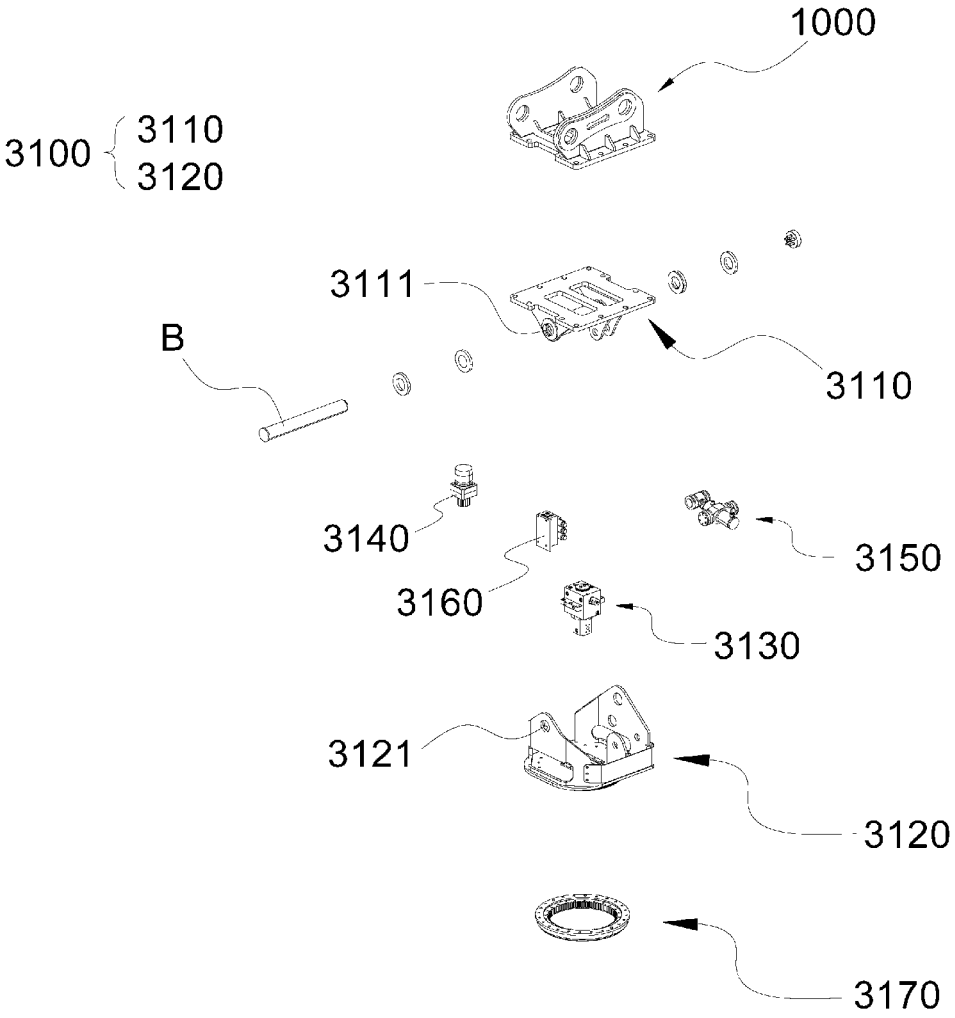
FIG. 2B is an exploded perspective view illustrating a configuration of an upper housing bracket according to the present disclosure.
Figure 3A:
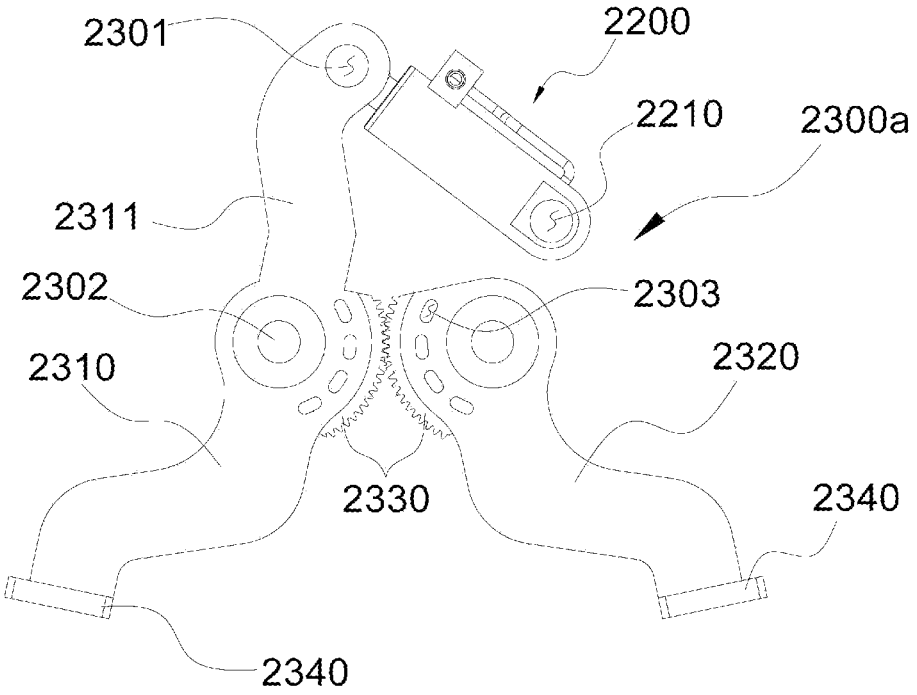
FIGS. 3A and 3B are a view schematically illustrating configurations of a cylinder and an arm of the present disclosure.
Figure 3B:
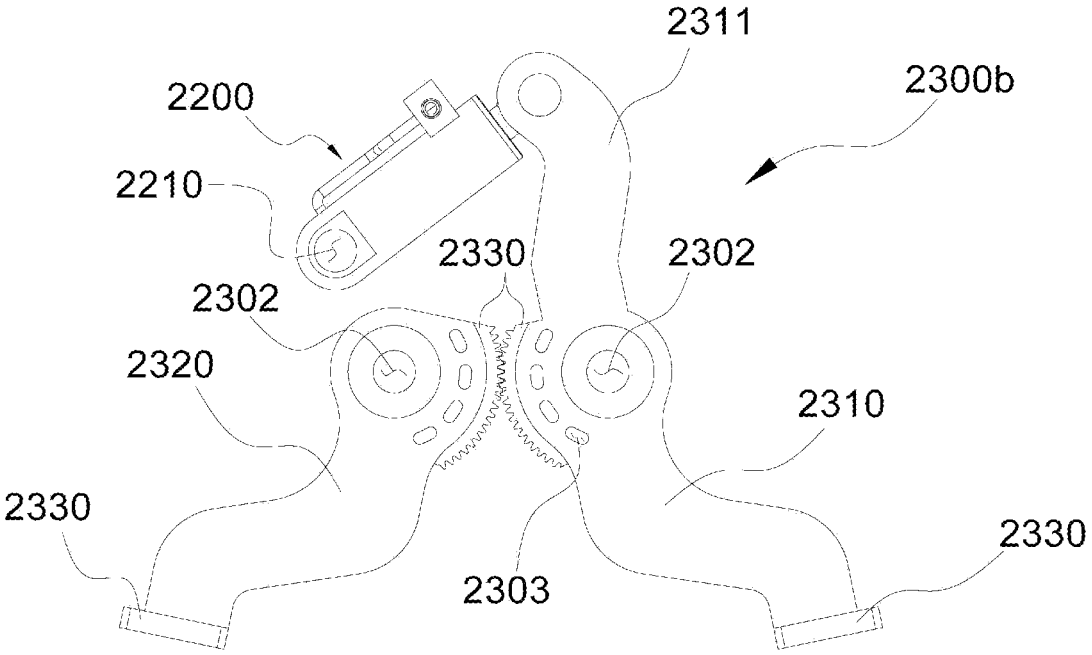
Figure 4:
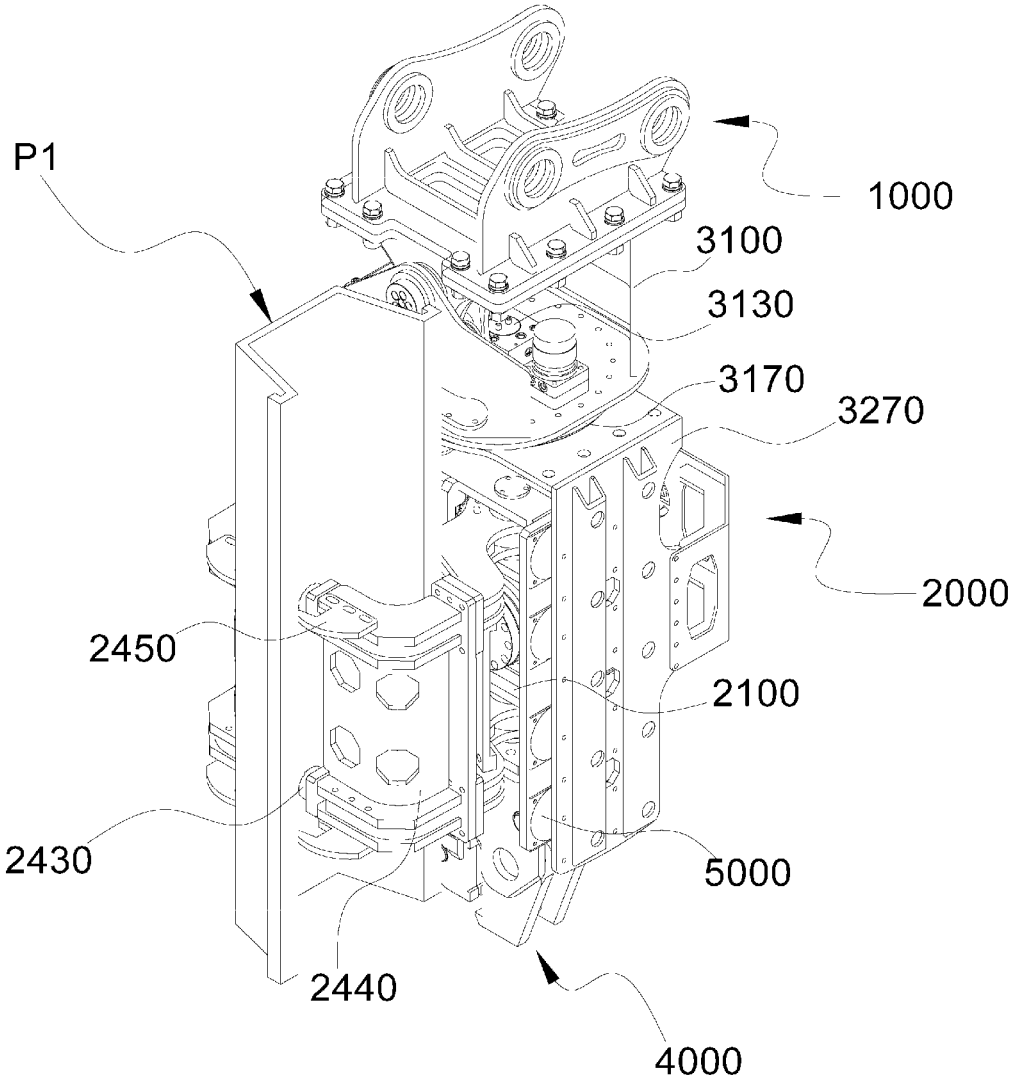
FIG. 4 is a view illustrating an application example of a sheet pile.
Figure 4A:
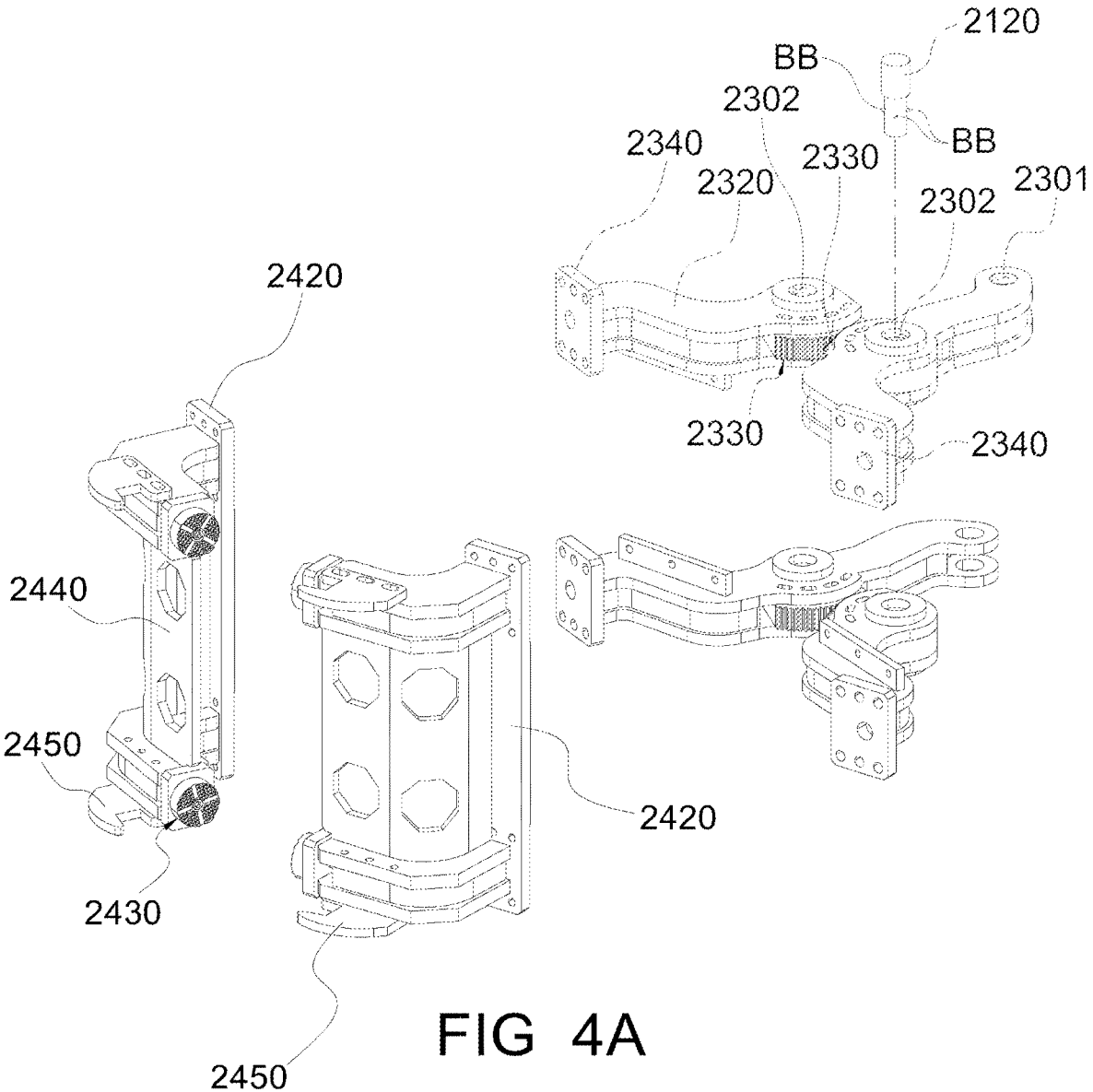
FIG. 4A is an exploded perspective view illustrating an arm and a side grip of FIG. 4.
Figure 4B:
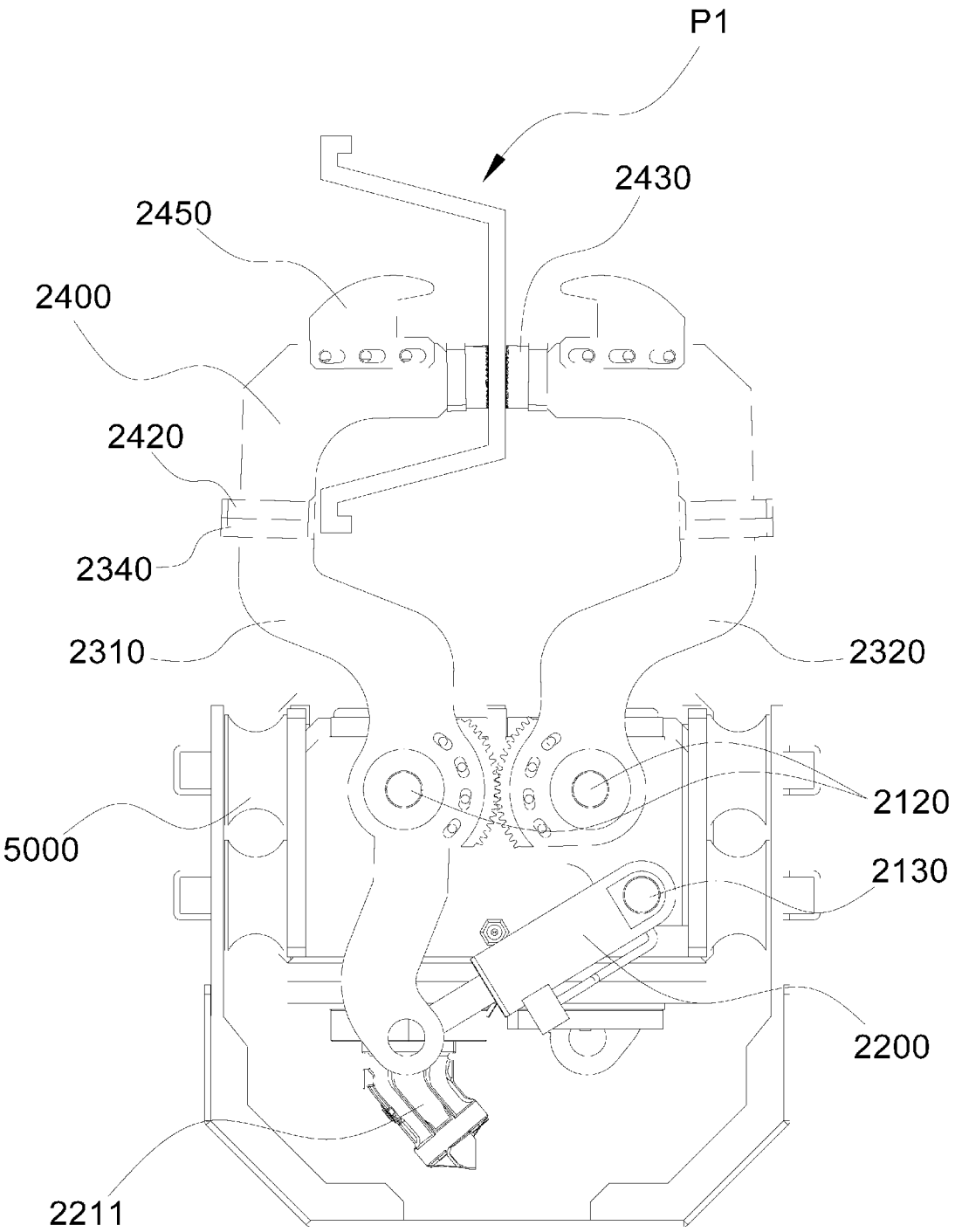
FIG. 4B is a schematic plan view of the FIG. 4.
Figure 5:
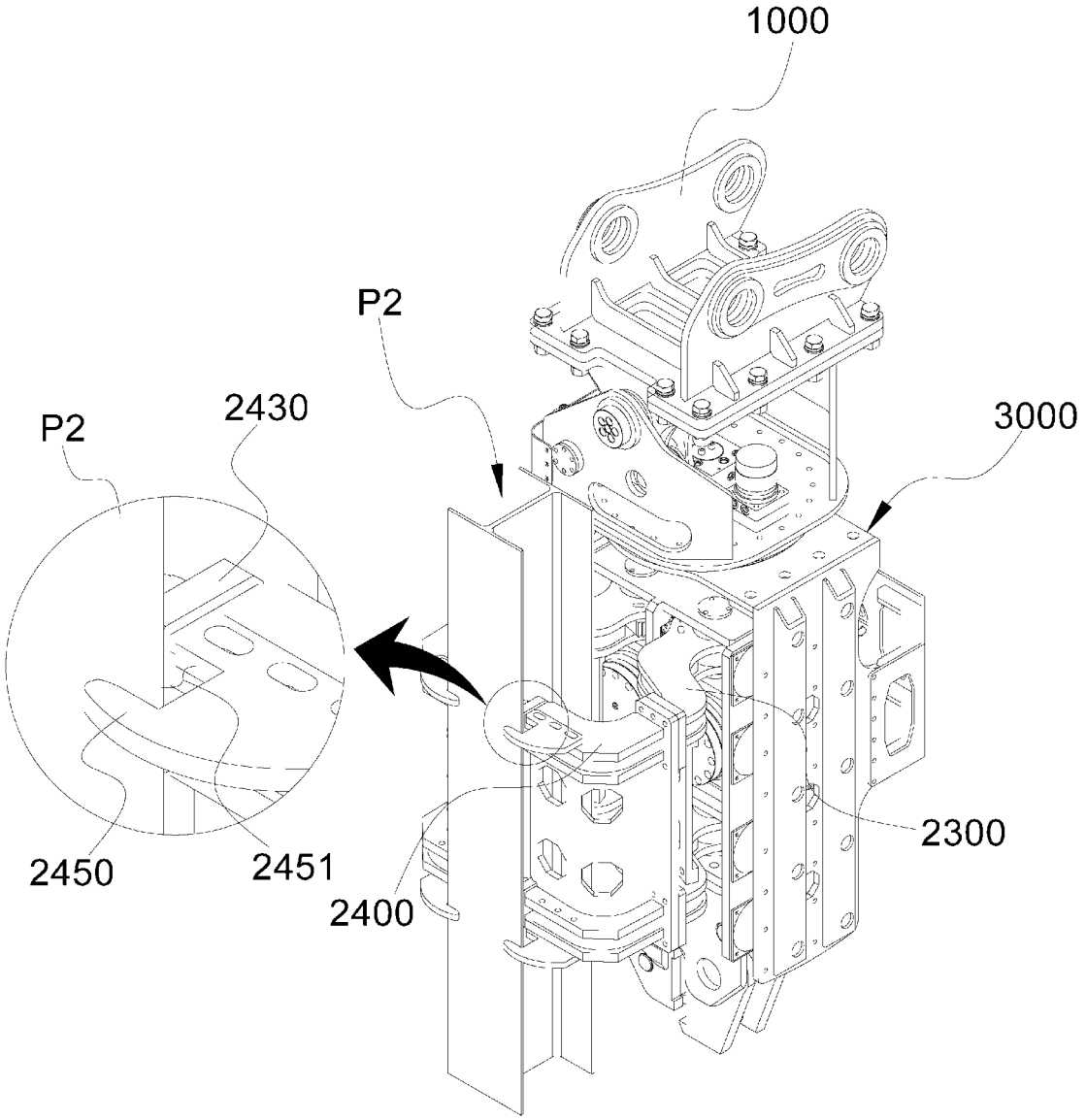
FIG. 5 is a perspective view and a partial enlarged view of an application example of an I-type pile.
Figure 5A:
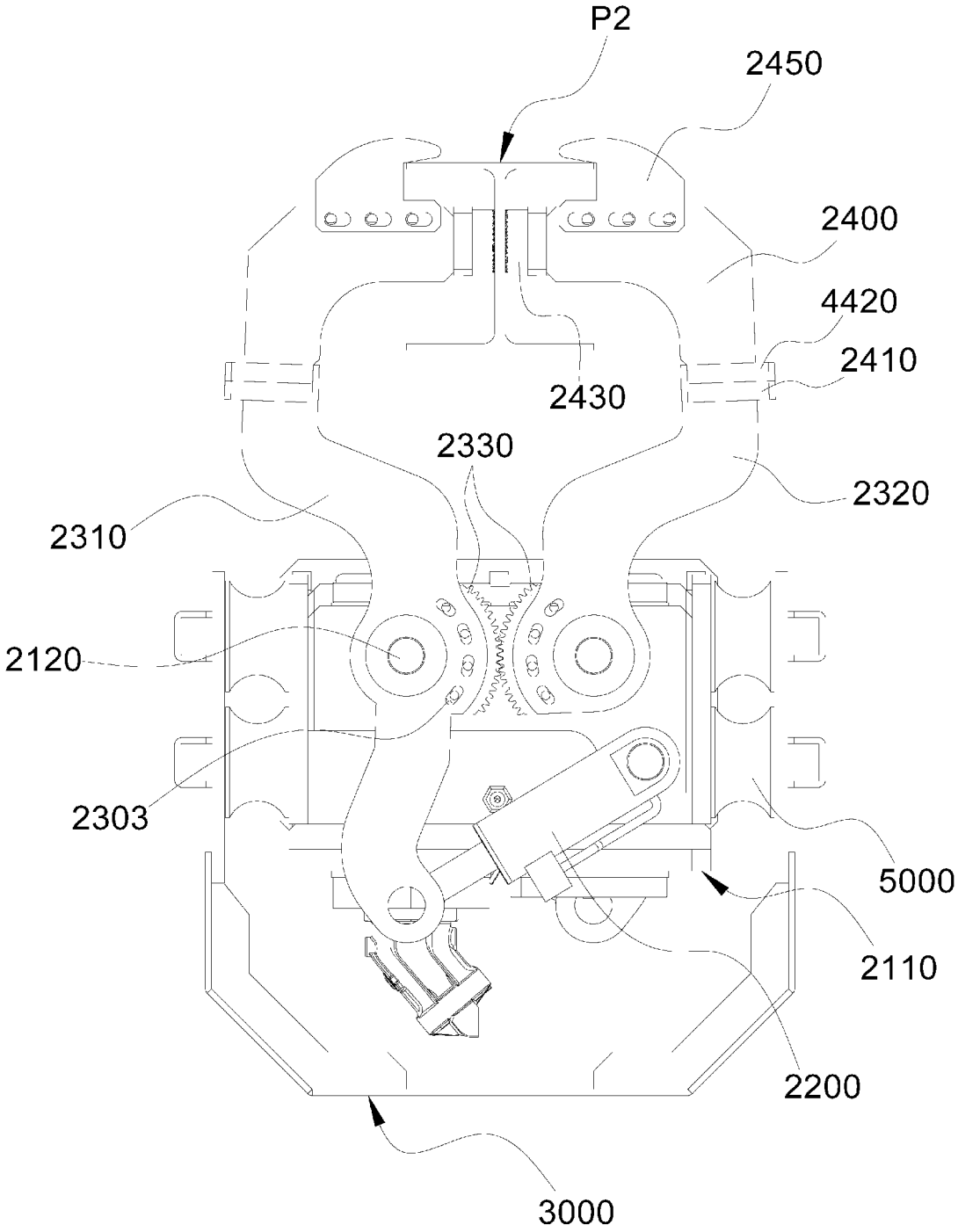
FIG. 5A is a schematic plan view of FIG. 5.
Figure 6:
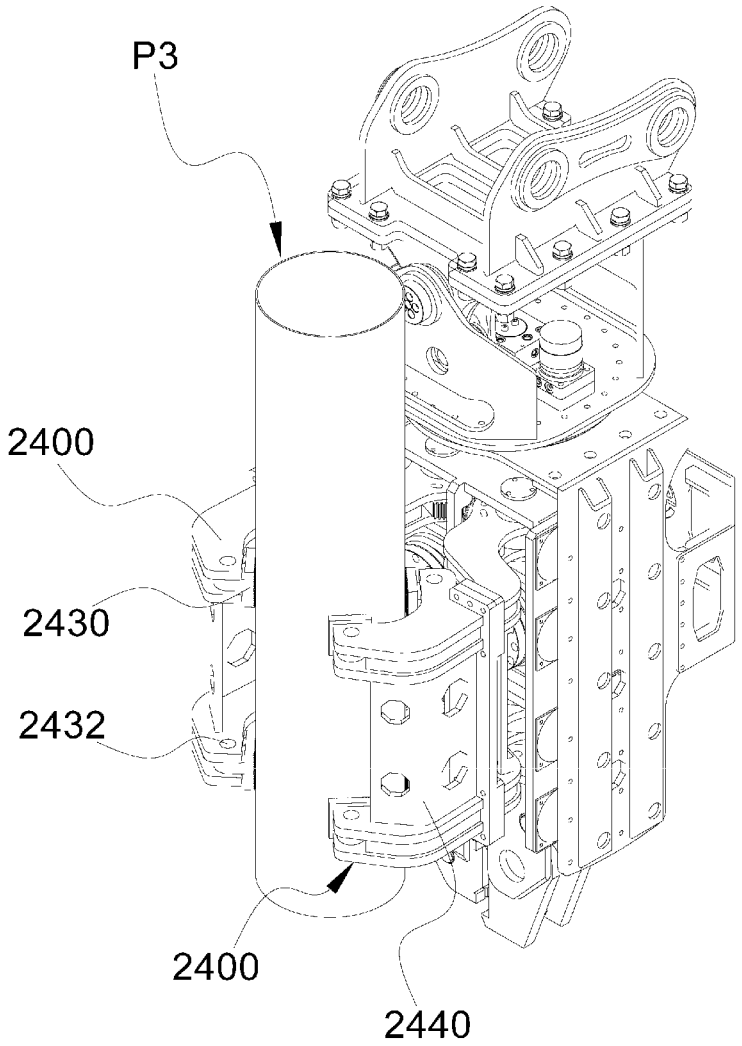
FIG. 6 is a view illustrating an application example of a circular pile.
Figure 6A:
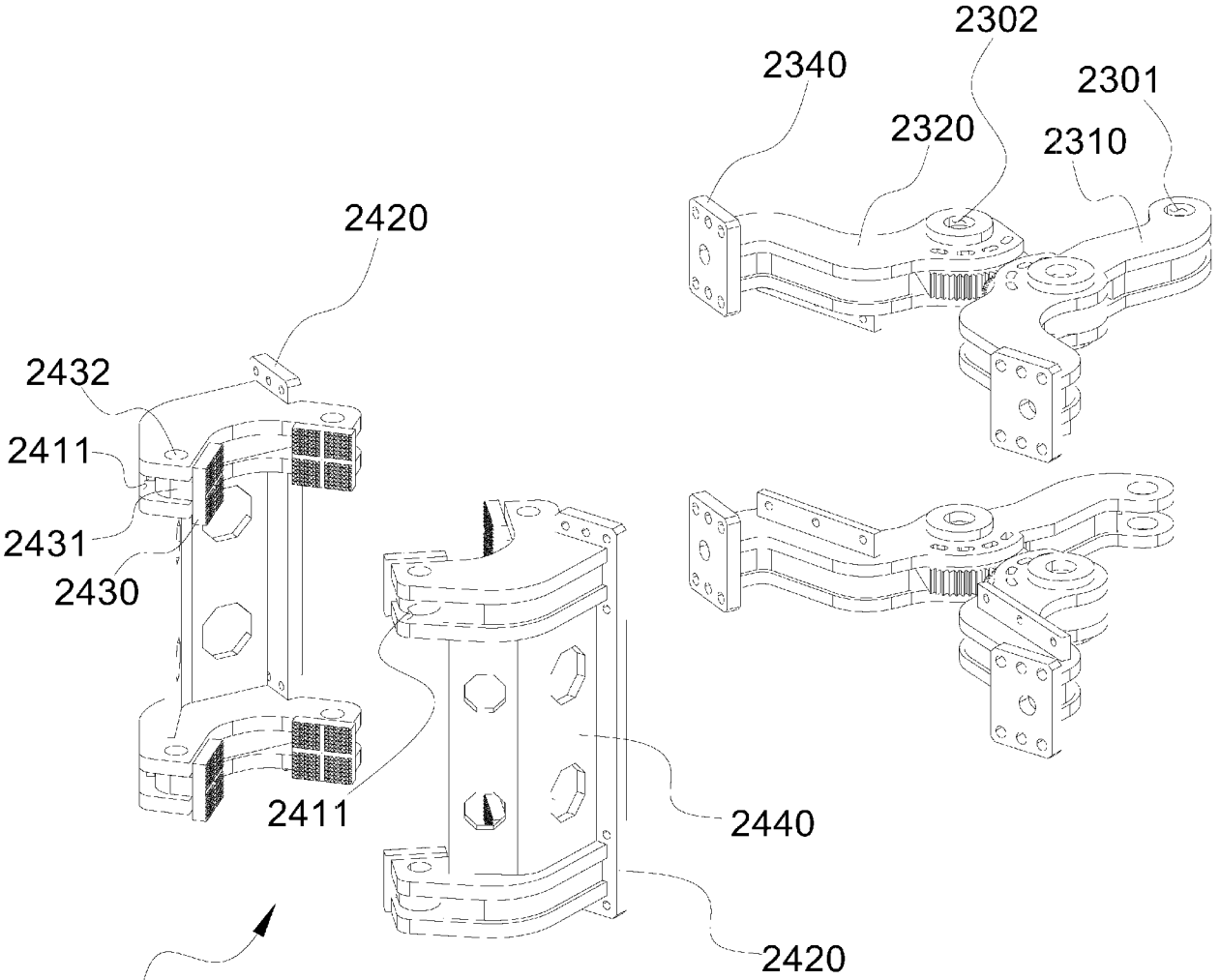
FIG. 6A is an exploded perspective view of another embodiment of the side grip and the arm according to the present disclosure.
Figure 6B:
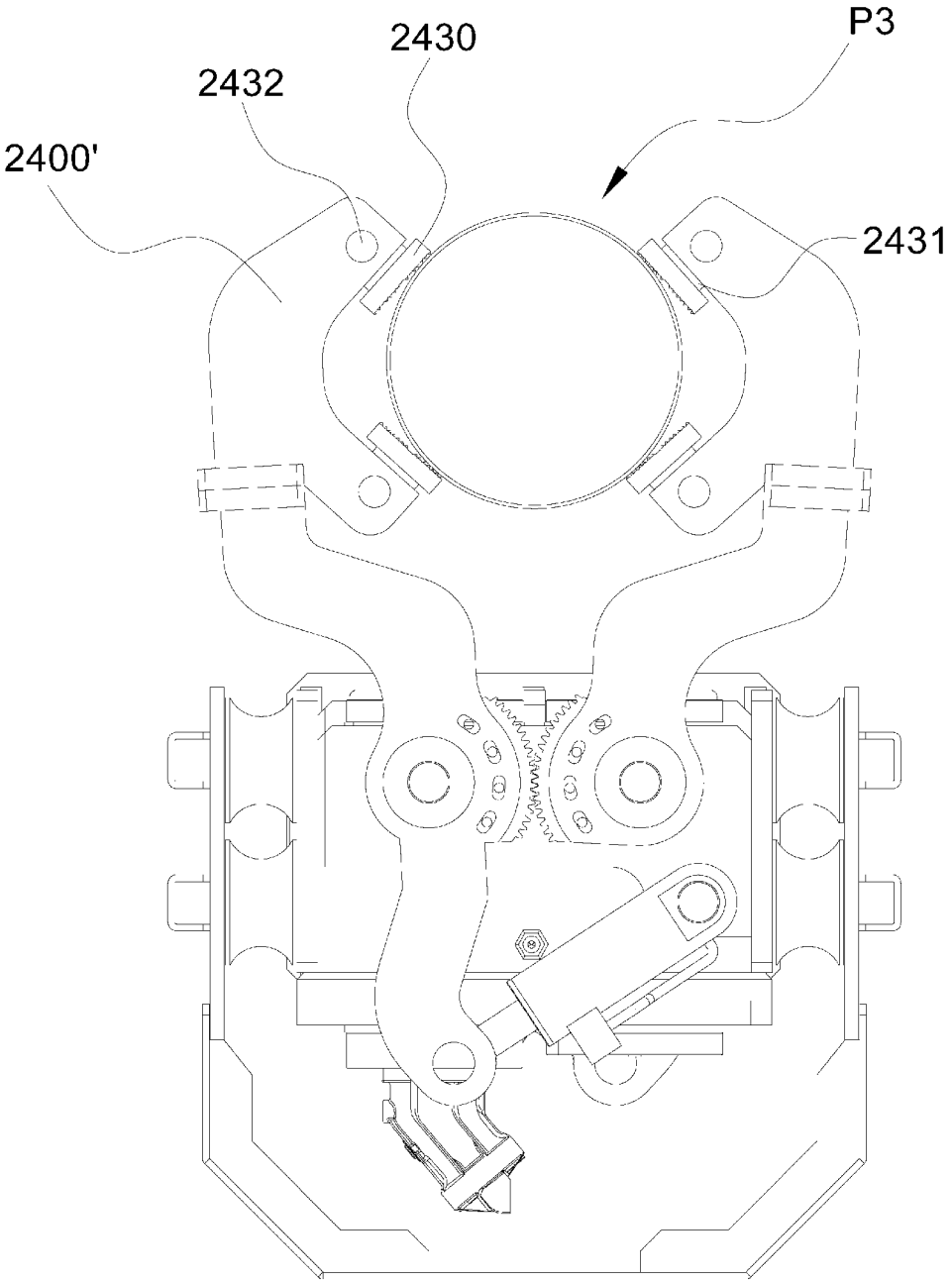
FIG. 6B is a schematic plan view of FIG. 6.
Figure 6C:
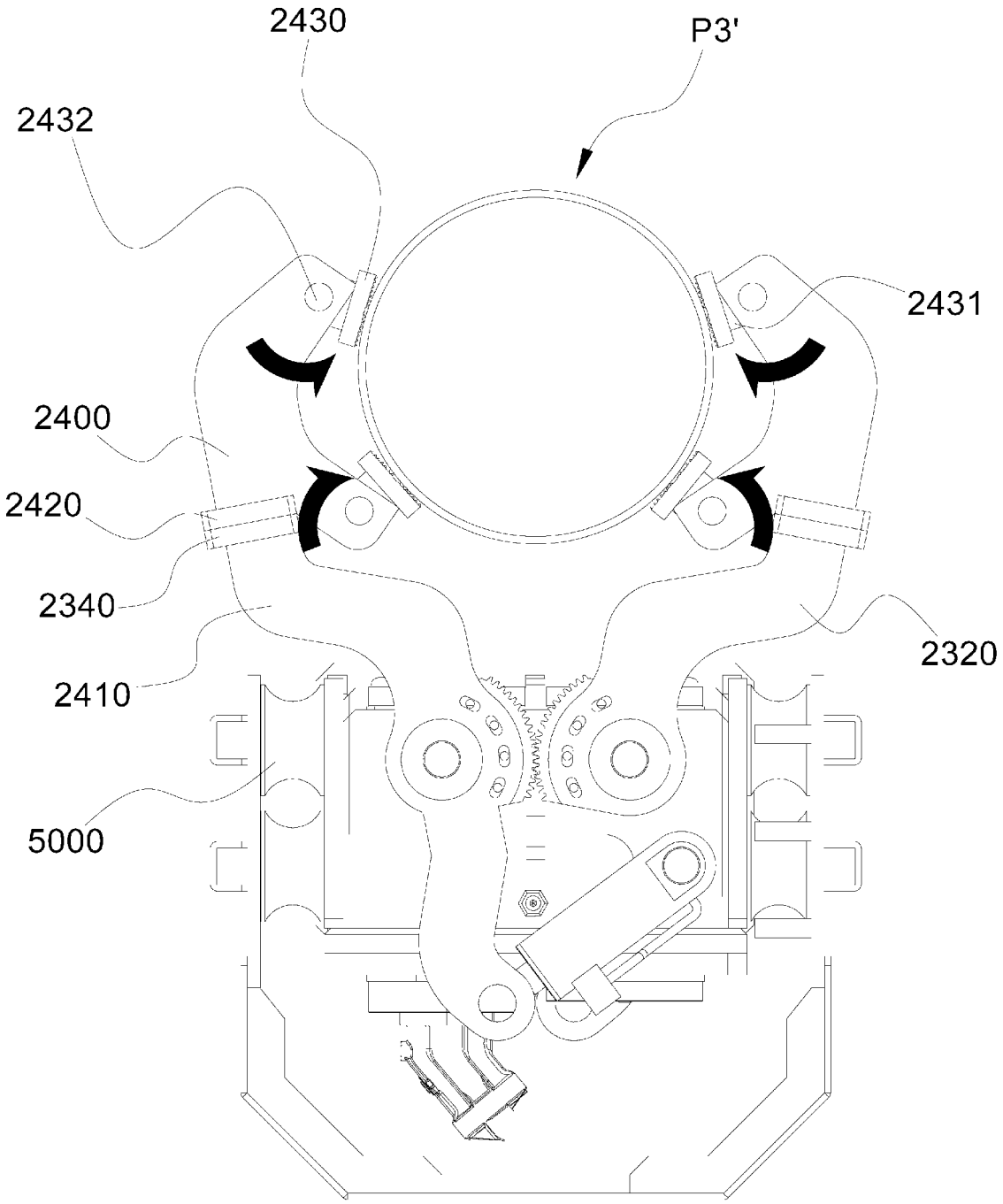
FIG. 6C is a plan view schematically illustrating another embodiment of the circular pile.
Figure 7:
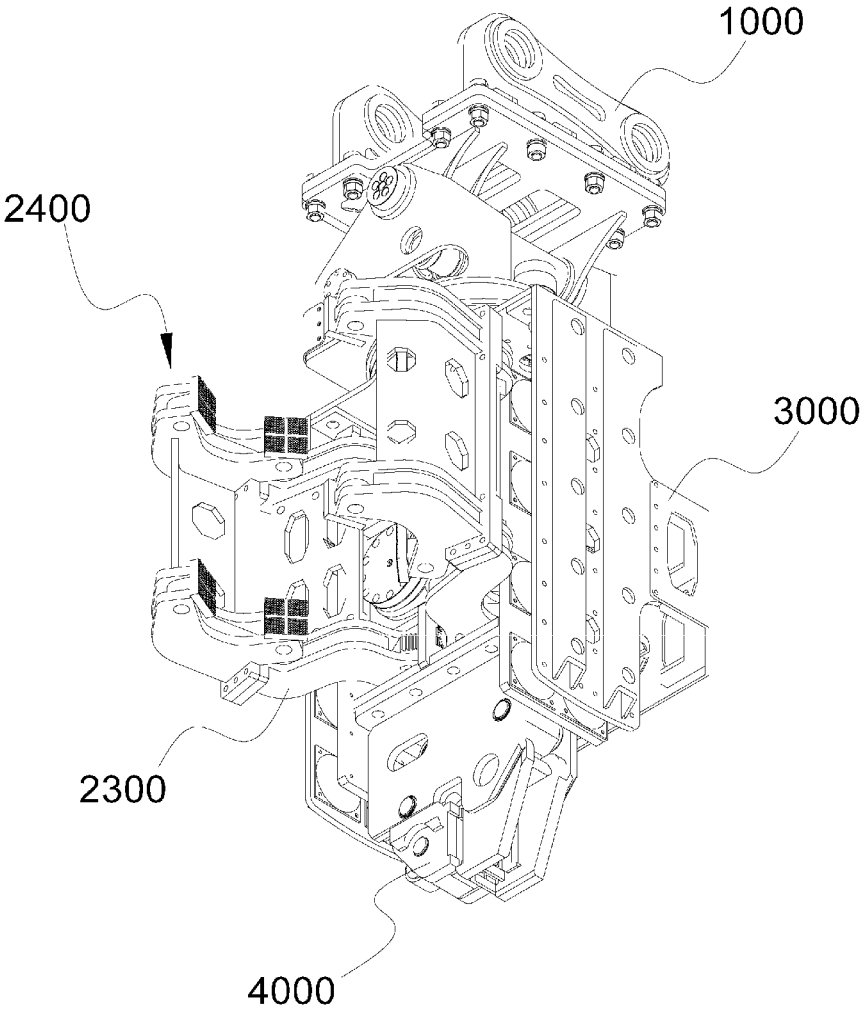
FIG. 7 is a perspective view illustrating a lower surface of the vibro-hammer having a side grip according to the present disclosure.

FIG. 1 is a perspective view illustrating a configuration of a vibro-hammer having a side grip according to the present disclosure, FIG. 2 is an exploded perspective view illustrating the vibro-hammer having a side grip according to the present disclosure, FIG. 2A is an exploded perspective view illustrating an internal configuration of a gear box module according to the present disclosure, FIG. 2B is an exploded perspective view illustrating a configuration of an upper housing bracket according to the present disclosure, FIG. 3A and FIG. 3B are a view schematically illustrating configurations of a cylinder and an arm of the present disclosure, FIG. 4 is a view illustrating an application example of a sheet pile, FIG. 4A is an exploded perspective view illustrating an arm and a side grip of FIG. 4, FIG. 4B is a schematic plan view of the FIG. 4, FIG. 5 is a perspective view and a partial enlarged view of an application example of an I-type pile, FIG. 5A is a schematic plan view of FIG. 5, FIG. 6 is a view illustrating an application example of a circular pile, FIG. 6A is an exploded perspective view of another embodiment of the side grip and the arm according to the present disclosure, FIG. 6B is a schematic plan view of FIG. 6, FIG. 6C is a plan view schematically illustrating another embodiment of the circular pile, and FIG. 7 is a perspective view illustrating a lower surface of the vibro-hammer having a side grip according to the present disclosure.

Prior to the description, the perforated pile described in the present disclosure is divided into a sheet pile Pl, an I-type pile P2, and circular piles P3 and P3' according to the shapes thereof, and when explaining by applying different perforated piles Pl, P2, and P3 as necessary, it should be stated that the description is given with reference numerals.

The present disclosure relates to a vibro-hammer connected to heavy construction equipment, and more particularly, a vibro-hammer having a side grip in which vibrations are prevented from being transmitted to a connected heavy equipment machine to avoid a problem such as a change in a perforation position and the vibro-hammer is firmly connected to a perforated pile to transmit vibrations generated in a gear box to the perforated pile through the side grip and improve workability, and the vibro-hammer 1 includes a mount portion 1000, a side clamp portion 2000, a housing bracket 3000, and a bottom clamp 4000.

The mount portion 1000 is connected to a boom bracket or quick coupler installed at a distal end of a boom of a construction heavy equipment machine such as an excavator and shovel.

The mount portion 1000 has a plurality of holes which are formed on an upper surface to be coupled to the heavy equipment machine, and a lower surface of the mount portion 1000 is coupling-fixed in close contact with an upper surface of the housing bracket 3000 in a vertical direction.

The side clamp portion 2000 generates vibrations through a provided gear box module 2110 provided to transmit the vibrations to a connected arm 2300 and a side grip 2400, and plays a role of easily griping and vibrating the perforated pile so as to perform perforation work. This side clamp portion 2000 includes a gear box 2100, a cylinder 2200, the arm 2300 and the side grip 2400.

The gear box 2100 includes the gear box module 2110 therein and has a box frame 2101 in the shape of a hexahedron with opened front surface and rear surface, and inside the box frame 2101, a plurality of horizontal frames 2102 divided into regions along an inner height of the box frame 2101 are provided.

First, a cylinder coupling shaft 23130 coupled to an upper arm 2300*a* descried later and a pair of rotating shafts 2120 are provided inside the uppermost horizontal frame, and the pair of gear box modules 2110 is provided at a center of the inside of the box frame 2101 having the horizontal frame 2102 as upper and lower surfaces, and thus, generates vibrations.

A hydraulic motor 2111 is provided on a rear surface of the gear box module 2110 to generate vibrations, and as illustrated in FIG. 2A, a gear 2110*b* and an eccentric weight 2110*c* are coupled to shaft 2110*a* inside the gear box module 2110 to generate vibrations.

The vibrations generated by the gear box module 2110 is connected to the box frame 2101 and the horizontal frame 2102, and is transmitted to the arm 2300 and the side grip 2400 connected to the gear box 2100. Accordingly, the perforated pile gripped by the side grip 2400 is vibrated.

A horizontal frame 2102 having a vertical distance corresponding to the heights of the rotating shaft 2120 and the cylinder coupling shaft 2130 is also provided on the lower side where the gear box module 2110 is provided. That is, the inside of the box frame 2101 is divided into three zones, the gear box module 2110 generating vibrations is provided at the center thereof, and on upper side and lower side based on the gear box module 2110, the rotating shaft 2120 and the cylinder coupling shaft 2130 coupled to the cylinder 2200 and the arm 2300 are coupled to the horizontal frame 2102 located in the vertical direction, and thus, the cylinder 2200 and the arm 2300 are not deviated from installation positions thereof, and are connected to the box frame 2101 to receive vibrations.

Moreover, an engagement portion 2140 is provided on a front surface on which the rotating shaft 2102 and the cylinder coupling shaft 2130 so as to prevent the pair of arms 2300 from excessively rotating inward. That is, an engagement groove 2141 is formed on the rear surface side of the engagement portion 2140 to be recessed in the front surface direction from the rear surface, and in order to prevent the gear-coupled first and second arms 2310 and 2320 from being separated from each other due to excessive rotation of a gear arm 2330 described later, the first and second arms are gear-coupled inside the engagement groove 2141.

Moreover, a front frame 2103 is provided on the front surface side of the gear box 2100, the arm 2300 is introduced into an inlet/outlet hole 2104 formed to horizontally penetrate the front frame 2103 so as to move the inside of the inlet/outlet hole 2104, and thus, the pair of arms 2300 can be prevented from excessively rotating.

The rotating shaft 2120 vertically penetrates rotating shaft introduction holes 2302 respectively formed in the first and second arms 2310 and 2320, the first and second arms 2310 and 2320 can rotate about the coupled rotating shaft 2120, the cylinder coupling shaft 2130 penetrates the shaft coupling hole 2210 formed on one end of the cylinder 2200 and is coupled thereto, the other end of the cylinder 2200 is coupled to the first arm 2310 formed in the cylinder coupling hole 2301 of the arm 2300 to drive the cylinder 2200, and thus, the first arm 2310 rotates about the rotating shaft 2120.

The cylinder 2200 is driven so that the connected arm 2300, that is, the first arm 2310 rotates about the coupled rotating shaft 2120. When the first arm 2310 is rotated to one side by the driving of the cylinder 2200, the pair of arms 2300 is close to each other, comes into close contact with the outer surface of the perforated pile to grip the perforated pile, or when the first arm 2310 rotates to the other side, the pair of arms 2300 is away from each other to be separated from the outer surface of the perforated pile, and thus, is detached from the perforated pile.

The cylinder 2200 may be driven by a heavy equipment machine connected to the vibro-hammer 1 or a separate operation module (not illustrated in the drawings) provided outside. As illustrated in FIG. 3A and FIG. 3B, the cylinder 2200 is provided on a side opposite to the positions of the upper arm 2300*a* and the lower arm 2300*b*. Therefore, the side clamp portion 2000 is prevented from being bent one side due to that the cylinder 2200 is driven to one side, and the cylinders 2200 are provided to intersect each other. Accordingly, the side clamp portion 2000 uniformly grips the perforated pile and grips the perforated pile with a good balance, and thus, the side clamp portion 2000 also has a good balance and is prevented from being pulled to one side.

The arm 2300 connected to the cylinder 2200 and the rotating shaft 2120 of the gear box 2100 is divided into the upper arm 2300*a* located above the gear box 2110 and the lower arm 2300*b* located below the gear box 2110, and thus, the pair of arms 2300 includes the first arm 2310 and the second arm 2320.

First, in each of the upper arm 2300*a* and the lower arm 2300*bb*, the first arm 2310 and the second arm 2320, and the cylinder 2200 are provided on sides opposite to each other in the vertical direction, and thus, when the cylinder 2200 is driven, the first arm 2310 and the second arm 2320, and the cylinder 2200 intersect each other in a plan view.

Each of the upper arm 2300*a* and the lower arm 2300*b* is coupled to the side grip 2400, and not simply grip only one side of the perforated pile but grips upper and lower portions on the same vertical line to be in stable-close contact with the perforated pile and fixed to the perforated pile.

The first arm 2310 and the second arm 2320 have the same shape as each other, and the first arm 2310 has a cylinder coupling hole 2301 for coupling the cylinder 2200 on an end portion extending to the cylinder 2200 side.

In each of the first arm 2310 and the second arm 2320, the rotating shaft introduction hole 2302 is formed so that the rotating shaft 2120 vertically penetrates and is coupled to the arm, and gear arms 2330 are formed at a position close to the rotating shaft introduction hole 2302 so that the first arm 2310 and the second arm 2320 are gear-coupled to each other.

The gear arm 2330 is provided on a side on which the rotating shaft introduction hole 2302 of each of the first arm 2310 and the second arm 2320 is provided, and teeth of the gear arm 2330 are formed to protrude the side of the other facing arm 2300. Moreover, in order to easily perform replacement later, the gear is not directly formed on the arm 2300, and the gear arm 2330 formed along a side surface according to a degree of the rotation of the arm 2300 is coupled to the gear coupling hole 2303 so that the arm 2300 and the gear arm 2330 can be coupled.

That is, the upper surface of the gear arm 2330 is provided with a protrusion protruding upward according to the position of the gear coupling hole 2303 which can penetrate the inside of the gear coupling hole 2303, the protrusion is introduced into the gear coupling hole 2303, and thus, the gear arm 2330 and the arm 2300 can be coupled to each other. In addition, when a gear portion of the gear arm 2330 is worn due to frequent use, or the like, only the gear arm 2330 can be removed from the arm 2300 and replaced.

The first arm 2310 and the second arm 2320 protrude to the front surface side of the gear box 2100 about the position where the rotating shaft coupling hole 2210 is formed, and the side surfaces of the perforated piles are easily provided inside, and protrude in a lateral direction so that the perforated pile is easily provided therein.

Moreover, a first coupling bracket 2340 which can be coupled to the side grip 2400 is provided on a protruding end portion of each of the first arm 2310 and the second arm 2320. The first coupling bracket 2340 comes into close contact with the second coupling bracket 2420 of the side grip 2400 described later, and a separate coupling member such as a bolt penetrates the first coupling bracket 2340 and the second coupling bracket 2420, and thus, the first and second coupling brackets 2340 and 2420 are fixed to each other.

Accordingly, the first and second arms 2310 and 2320 are coupled to the rotating shaft 2120 in the gear box 2100, and vibrations generated in the gear box module 2110 can be transmitted to the side grip 2400 side through the arm 2300.

One end of the side grip 2400 is connected to the arm 2300 so that the side grip 2400 receives the vibrations transmitted from the gear box 2100 side, the other end of the side grip 2400 comes into close contact with the perforated pile to be fixed thereto, the vibrations transmitted from the gear box 2100 side is transmitted to the close contacted perforated pile, and thus, the perforated pile can perform perforation work by the vibrations.

The side grip 2400 extends similarly to the arm 2300 of which one end extends, and an end portion side of the side grip 2400 includes a side grip frame 2410 curved inward so that the side grip 2400 comes into close contact with the perforated pile provided inside.

One end of the side grip frame 2410 includes the second coupling bracket 2420 to be coupled to the above-described first coupling bracket 2340.

In this case, in the second coupling bracket 2420, the second coupling bracket 2420 has a height corresponding to the pair of first coupling brackets 2340 located at the same vertical line so that the upper arm 2300*a* and the lower arm 2300*b* are coupled by one side grip 2400 and the pair of first coupling bracket 2340 respectively provided in the upper arm 2300*a* and the lower arm 2300*b* and located on the same vertical line are coupled to the single second coupling bracket 2420 (refer to FIGS. 4A and 6A).

The second coupling bracket 2420 allows the upper arm 2300*a* and the lower arm 2300*b* to come into close contact with the perforated pile in the same way through the second coupling bracket 2420 even if the upper arm 2300*a* and the lower arm 2300*b* are not driven equally due to a slight difference.

The other end of the side grip frame 2410 includes a close-contact portion 2430 which comes into close contact with the outer surface of the perforated pile.

In the close-contact portion 2430, a close-contact surface in close contact with the perforated pile includes a slight protrusion having a pyramid shape to increase a friction force with the outer surface of the perforated pile and secure stable fixing and coupling. Moreover, a shape of the protrusion may be configured in an embodiment illustrated in FIGS. 4 and 5 or another embodiment illustrated in FIG. 6 according to the shape of the perforated pile.

A user of the side grip 2400 having the above-described embodiments separate the first and second coupling brackets 2340 and 2420 coupled according to the shape of the perforated pile from each other, and thereafter, couples the second coupling bracket 2420 of the side grip 2400 to be used to the first coupling bracket 2340. Accordingly, the user can use the side grip 2400 matching the perforated piles having various shapes.

First, when the perforation work is performed using the sheet pile P1, as illustrated in FIG. 4*a*, the close-contact portion 2430 having a columnar shape in which the close-contact portion 2430 is connected to the other end of the side grip frame 2410 is used, and a plurality of protrusion are formed on the close-contact surface of the close-contact portion 2430.

In this case, together with the second coupling bracket 2420, a vertical bracket 2440 which connects the side grip 2400 coupled to the upper arm 2300*a* and the lower arm 2300*b* to the side grip 2400 located on the same vertical line may be provided.

The vertical bracket 2400 prevents the side grip 2400 from being inclined downward due to frequent vibrations and load, and the side grips 2400 located on the upper side and lower side at equal intervals can come into close contact with the perforated pile similarly.

In this case, the vertical bracket 2440 may be contracted or expanded due to thermal deformation or the like. When the vertical bracket 2440 is warped, since the position of the side grip 2400 connected to the upper and lower ends is changed, preferably, a plurality of perforation holes are provided in the vertical bracket 2440.

Accordingly, as illustrated in FIG. 4B, in the sheet pile P1 having the above-described configuration, the close-contact portion 2430 comes into close contact with the inside of the sheet pile P1, both end portions of the sheet pile P1 protruding to one side are provided between the arm 2300 extending outward and the side grip 2400, and thus, the close fixing of the perforated pile can be realized.

Thereafter, when the cylinder 2200 is driven and contracted, the first arm 2310 coupled to the cylinder 2200 rotates about the rotating shaft 2120, the gear arm 2330 coupled to the first arm 2310 and the gear arm 2330 of the gear-coupled second arm 2320 rotate in directions opposite to each other, and thus, the second arm 2320 and the first arm are away from each other, the side grips 2400 which are connected to the first and second arms 2310 and 2320 and located at the same horizontal line are away from each other, the close-contact portion 2430 and the perforated pile are away from each other, and thus, the perforated pile and the side grip 2400 can be separated from each other.

Meanwhile, when the I beam (P2) other than the sheet pile P1 and the side grips 2400 are coupled to each other, an auxiliary close-contact portion 2450 which locks the end portions protruding to the side surface of the I beam P2 to the side grip 2400 so as to further fix the I beam P2 may be formed.

The auxiliary close-contact portion 2450 is provided on a front surface side of the side grip 2400 to protrude to the close-contact portion 2430 side, and has a close-contact groove 2451 which is recessed in a direction opposite to the close-contact surface of the close-contact portion 2430.

When the side grip 2400 comes into close contact with the I beam P2, the end portion protruding inside the close-contact groove 2451 can be introduced, and thus, as illustrated in FIG. 5A, the end portion of the I beam P2 can be locked to the inner surface of the close-contact groove 2451 in the auxiliary close-contact portion 2450 to be fixed thereto.

Accordingly, the auxiliary close-contact portion 2450 can fix the side grip 2400 together with the close-contact portion 2430, and even when the I beam P2 is deviated from the side grip 2400 due to excessive vibrations, the I beam P2 is locked to the inside of the close-contact groove 2451, and thus, the I-beam P2 does not move or deviate over a predetermined radius.

Meanwhile, When the outer surface is curved such as the circular pile P3, it is difficult to fix the circular pile P3 to the side grip 2400 in a close contact state by only the pair of close-contact portions 2430. Particularly, when strong vibrations are applied, the side grip 2400 slides along the curved outer surface of the circular pile P3, and thus, there is a concern that the circular pile P3 is deviated from the inside of the side grip 2400.

Accordingly, in another embodiment of the side grip 2400, the pair of close-contact portions 2430 is provided, and the side grip 2400 can be rotated along the curvature of the outer surface of the circular pile P3, which will be described with reference to FIGS. 6 to 6C.

In another embodiment of FIG. 6, when the side grip 2400 comes into contact with the circular pile P3, as illustrated in FIG. 6*b*, the close-contact portion 2430 has a contact point in a tangential form on the outer surface of the circular pile P3, and the close-contact portion 2430 can come into close contact with the outer surface about the contact point and be fixed thereto.

In this case, in one side grip 2400, that is, in the side grip 2400 coupled to the upper arm 2300*a* and the lower arm 2300*b*, the pair of close-contact portion 2430 located on the same horizontal line is separated from each other and is provided inside the side grip 2400, and the side grip 2400 comes into close contact with the circular pile P3 to surround upper portion and lower portion of one side and the other side of the circular pile P3 and is fixed thereto.

Meanwhile, the pair of close-contact portions 2430 may be disposed to face the center of the inside of the side grip 2400. However, when the close-contact portion 2430 is fixed thereto, there is a concern that the close-contact portion cannot come into close contact with the circular pile P3 having various outer diameters.

Accordingly, in the present disclosure, the close-contact portion 2430 can rotate so that the close-contact portion 2430 comes into close contact with the outer surface of the circular pile P3 having various diameters in a tangential form.

A protruding rotation portion 2431 is provided on a surface opposite to the surface on which the close-contact surface is formed, and the rotation portion 2431 has a hole penetrating vertically.

Moreover, the other end of the side grip 2400, that is, an end portion on which the close-contact portion 2430 is provided has a rotation portion moving groove 2411 in which an end surface corresponding to a height of the rotation portion 2431 is recessed.

The rotation portion moving groove 2411 is recessed in a state where a front surface and a rear surface are open on the other end of the side grip frame 2410, the rotation portion 2431 is introduced into the rotation portion moving groove 2411, and thus, the rotation portion 2431 can rotate along the rotation portion moving groove 2411.

In addition, a hole vertically penetrating the upper and lower surfaces of the side grip frame 2410 is formed on the upper and lower surfaces of the side grip frame 2410 in which the rotation portion moving groove 2411 is formed, a hole vertically penetrating the rotation portion 2431 is formed in the rotation portion 2431 introduced into the rotation portion moving groove 2411, and the hole communicating with the inside of the rotation portion moving groove 2411 communicates with the inside of the hole formed in the rotation portion 2431 and can be coupled thereto.

Thereafter, the close-contact portion rotating shaft 2120 is provided, which vertically passes through the hole formed in the side grip frame 2410 and the hole formed in the rotation portion 2431 and fixes the rotation portion 2431 to the end portion of the side grip frame 2410.

Therefore, as illustrated in FIG. 6C, the rotation portion 2431 can automatically rotate (direction of arrow) about the close-contact portion rotating shaft 2120, the close-contact portion 2430 also rotates together according to the rotation of the rotation portion 2431 and comes into close contact with the outer peripheral surface of the circular pile P3' provided inside the close-contact portion 2430 in a tangential form, and thus, the side grip 2400 can come into close contact with the circular pile P3' and can be fixed thereto.

In this case, a ball bearing (BB) is provided on an outer surface of the close-contact portion rotating shaft 2120, that is, outer surfaces of an upper end and a lower end penetrating the side grip 2400 so that the close-contact portion rotating shaft 2120 can easily rotate the rotation portion 2431. Accordingly, the user can rotate the arm 2300 without separately rotating the rotation portion 2431, and thus, the close-contact portion 2430 can come into close contact with the outer surfaces of the circular piles P3 and P3' and can automatically rotate in a tangential form to come into close contact with the circular piles P3 and P3.

In another embodiment of the side grip 2400, not only the sheet pile P1 or the I beam P2 but also the circular piles P3 and P3 can be easily fixed to the side grip 2400. Moreover, the side grip 2400 comes into close contact with the circular pile P3 and automatically rotates according to the outer peripheral surface of the circular pile P3. In addition, the close-contact portion 2430 comes into close contact with the outer peripheral surface of the circular pile P3 in a tangential form in order to increase a friction area, and it is possible to increase a close contact force and a fixing force.

The housing bracket 3000 is provided outside the above-described side clamp portion 2000, the gear box 2100 is coupling-fixed to an internal space of the housing bracket 3000, and an upper surface of the housing bracket 3000 is coupled to the lower surface of the mount portion 1000 so that the housing bracket 3000 is connected to the mount portion 1000 and the heavy equipment machine.

The housing bracket 3000 has a hexahedral shape with an open bottom surface and front and rear surfaces, and the gear box 2100 is provided inside the housing bracket 3000. In this case, the rear surface of the housing bracket 3000 is open so that the housing bracket 3000 does not interference with the cylinder 2200 when the cylinder 2200 described later moves horizontally, and a separate bracket for protecting the rear surface of the gear box module 2110 is further provided at a center side.

Accordingly, the arm 2300 and the side grip 2400 are provided on the open front surface of the housing bracket 3000, the bottom clamp 4000 is provided on the open bottom surface, the rear surface is partially open so that the end portion of the cylinder 2200 protrudes from or enters the open rear surface of the housing bracket 3000 according to the operation of the cylinder 2200, and the rear surface side of the gear box module 2110 is closed to be protected from the outside.

Particularly, when the perforation work is performed, in a case where fine sand or boulders move toward the gear box module 2110 side, malfunction of the gear box module 2110 is generated, and thus, it is necessary to protect the gear box module 2110.

In addition, when the vibrating side clamp portion 2000 is directly connected to the mount portion 1000, vibrations generated in the gear box module 2110 or impact generated due to the perforated pile coupled to the side grip 2400 colliding with the ground is transmitted to the heavy equipment machine side, the position of the heavy equipment machine is changed or malfunction of the machine is generated due to the frequent impact. Accordingly, in order to solve the problems, the housing bracket 3000 is provided outside the side clamp portion 2000, the mount portion 1000 is coupled to the housing bracket 3000, and thus, the impact or vibrations transmitted to the side clamp portion 2000 is reduced, and the impact or vibrations transmitted to the heavy equipment machine can be minimized.

The housing bracket 3000 includes an upper housing bracket 3100 which is directly coupled to the mount portion 1000, and a lower housing bracket 3200 which has an upper surface on which a rotary joint 3130 is provided, is coupled to the upper housing bracket 3100, and has a hexahedron shape having open front surface, rear surface, and lower surface.

First, the upper housing bracket 3100 has an upper surface having the same shape as the lower surface of the mount portion 1000, is coupled to the mount portion 1000 through a separate bolt in a state where the upper surface of the upper housing bracket 3100 is in close contact with the lower surface of the mount portion 1000, and is coupling-fixed to the mount portion 1000 in a close contact state.

The housing bracket 3100 includes a first upper housing bracket 3110 connected to the mount portion 1000 and a second upper housing bracket 3120 connected to the lower housing bracket 3200.

First, the first upper housing bracket 3110 has a shape corresponding to the lower surface of the mount portion 1000, edges of a front surface and a rear surface of the first upper housing bracket 3110 protrude downward, and the protruding end portion has a first coupling hole 3111 formed in the horizontal direction.

The second upper housing bracket 3120 has a circular lower surface, edges of a front surface and a rear surface of an upper surface of the second upper housing bracket 3120 protrude upward, and the protruding end portion has a second coupling hole 3121 formed in the horizontal direction.

Accordingly, the protruding upper surface and lower surface of the first upper housing bracket 3110 and the second upper housing bracket 3120 are combined with each other, a through bolt B penetrates the first coupling hole 3111 and the second coupling hole 3121, and thus, the first and second upper housing brackets 3110 and 3120 are coupled to each other.

In this case, a rotary motor 3140 which can rotate the lower housing bracket 3200, the side clamp portion 2000, and the bottom clamp 4000, a tilting cylinder 2200, and a hydraulic control valve 3160 are provided at a center vertically separated from the first and second upper housing brackets 3110 and 3120.

The rotary joint 3130 which penetrates vertically and connects the upper surface of the lower housing bracket 3200 to the lower surface of the second upper housing bracket 3120 is provided at the center of a lower surface of the second upper housing bracket 3120. Accordingly, the lower housing bracket 3200 can rotate about the rotary joint 3130 below the second upper housing bracket 3120, and the second upper housing bracket 3120 can maintain a fixed state through the coupled first upper housing bracket 3110.

A slugging bearing 3170 is provided at a space between the second upper housing bracket 3120 and the lower housing bracket 3200, and thus, the lower housing bracket 3200 can be easily rotated.

Accordingly, respective components of the hosing bracket 3000 are connected to each other but not in close contact with each other. That is, the components are coupled to each other in a state separated from each other, and thus, it is possible to minimize the vibrations generated from the side clamp portion 2000 from being transmitted to the mount portion 1000 and the heavy equipment machine.

Moreover, the side clamp portion 2000 can be easily rotated according to the position of the perforated pile, the perforated pile can be gripped in a closer contact state, and thus, it is possible to improve the coupling force and the fixing force.

When the perforated pile is driven into the ground at a predetermined depth or more through the side clamp portion 2000, the bottom clamp 4000 applies vibrations to the upper end of the perforated pile to perform the perforation work. That is, when the perforated pile is driven into the ground through the perforation work, the height of the side grip 2400 decreases, and in this case, there is a concern that the side grip 2400 is difficult to come into close contact with the outer peripheral surface of the perforated pile.

Accordingly, the bottom clamp 4000 applies vibrations to the upper end of the perforated pile drive into the ground, and thus, the perforated pile can be driven to a desired depth.

The bottom clamp 400 is inserted into the inside of the lower surface of the gear box module 2110 of the gear box 2100, and is coupling-fixed thereto.

Meanwhile, when the housing bracket 3000 comes into close contact with the gear box 2100 to be coupled thereto, there is a concern that the vibrations generated from the side clamp portion 2000 are transmitted to the mount portion 1000 and the heavy equipment machine through the housing bracket 3000.

Accordingly, an anti-vibration rubber 5000 may be further provided, which couples the gear box 2100 and the housing bracket 3000 to each other in a state of being separated from each other, and minimizes vibrations transmitted from the gear box 2100 to the housing bracket 3000 side.

A plurality of anti-vibration rubbers 5000 are interposed between both side surfaces of the gear box 2101 of the gear box 2100 and the housing bracket 3000, the vibrations generated from the gear box module 2110 are transmitted to the housing bracket 3000 through the anti-vibration rubbers 5000, and thus, it is possible to minimize the vibrations transmitted to the housing bracket 3000.

The anti-vibration rubber 5000 has a cylindrical shape of which an outer peripheral surface is curved to be recessed inward. Compared to a simple cylindrical rubber, in this anti-vibration rubber 500 having the cylindrical shape, a width of the anti-vibration rubber 5000 to which vibrations are transmitted is reduced, the vibrations are minimized, and thus, the vibrations transmitted through the anti-vibration rubber 5000 can be reduced.

In addition, anti-vibration rubber brackets 5001 are respectively provided on both side ends of the anti-vibration rubber 5000 and respectively fixed to the inner surface of the lower housing bracket 3200 and the outer surface of the box frame 2101. Accordingly, the gear box 2100 is coupled to the housing bracket 3000, the inner surface of the housing bracket 3000 and the outer surface of the gear box 2100 are separated from each other, and thus, the housing bracket 3000 and the gear box 2100 are prevented from being coupled to each other in a state of being in close contact with each other, and vibrations are prevented from being directly transmitted.

Meanwhile, the anti-vibration rubber 5000 has a number corresponding to height and width of the side surface of the box frame 2101 as illustrated in FIG. 2, and in the present disclosure, four pairs of anti-vibration rubber 5000 are disposed for each side surface of the box frame 2101. However, the present disclosure is not limited to this.

Hereinbefore, preferred embodiments are disclosed in the drawings and specification. Here, characteristic terms are used, but these are only used for the purpose of describing the present disclosure, and are not used to limit meaning or a scope of the present disclosure described in claims. Therefore, those of ordinary skill in the art will understand that various modifications and equivalent other embodiments are possible therefrom. Therefore, a true technical scope of the present disclosure should be determined by a technical spirit of the appended claims.

In this way, according to the present disclosure, it is possible to prevent vibrations from being transmitted to a connected heavy equipment machine to avoid a problem such as a change in a perforation position, the vibro-hammer is firmly connected to the perforated pile to transmit vibrations generated in the gear box to the perforated pile through the side grip, and thus, it is possible to improve workability.

Moreover, the arms are gear-coupled to each other to prevent the arms and the side grip from being released from each other due to frequent vibrations, the pair of arms and the side grip can come into close contact with the perforated pile or separated from the perforated pile by a single cylinder, the side grip can be easily replaced according a shape of the perforated pile, and thus, applicability and workability can be improved.

In addition, transmission of vibration to a heavy equipment machine can be minimized, and the upper and lower arms are alternately disposed when the arms are driven to have a good balance.

The effects of the present disclosure are not limited to the effects mentioned above, and other effects that are not mentioned will be clearly understood by those skilled in the art from the following description.

What is claimed is:

1. A vibro-hammer having a side grip which grips and vibrates a perforated pile, comprising:

a mount portion which is connected to a construction heavy equipment machine;

a side clamp portion which houses a gear box generating vibrations and includes a pair of arms and a pair of side grip;

a housing bracket which is coupled to the mount portion and the side clamp portion to connect the mount portion and the side clamp portion; and a bottom clamp which is located at a lower end of the side clamp portion to vibrate an upper end of the perforated pile; and an auxiliary close contact portion, wherein in the side clamp portion, a pair of rotating shafts is respectively provided in an upper portion and a lower portion of the gear box and one end of each of the pair of arms penetrates the rotating shaft to be coupled and rotates about the rotating shaft, one end of the side grip is coupled to the other end of the arm, and the other end of the side grip comes into close contact with or separated from an outer surface of the perforated pile, and the pair of arms includes a gear arm therein, and when the gear arm is gear-coupled to the arm and one arm is rotated, the other gear-coupled arm is also rotated, and the arm and the side grip is away from each other or close to each other, wherein the housing bracket is provided to be separated from a side surface of the side clamp portion, a plurality of anti-vibration rubbers are provided in a separate space between the housing bracket and the side clamp portion, and anti-vibration rubber brackets are provided on both side ends of the anti-vibration rubber, the anti-vibration rubber bracket is coupled to an inner surface of the housing bracket and the outer surface of the side clamp portion so that the side clamp portion is fixed to be separated from the housing bracket inside the housing bracket, wherein the side grip includes a close-contact portion which comes into close contact with an outer surface of the perforated pile when the perforated pile is gripped and has a plurality of protrusions on a close contact surface, and the pair of side rips is close to each other or away from each other according to a rotation of the arm, and the close-contact portion comes into close contact with or separated from the outer surface of the perforated pile, the auxiliary close contact portion which protrudes in a front direction from a front surface of the side grip and has an engagement groove recessed, and formed at a side surface of the close-contact portion, wherein a ball bearing is provided on the outer surface of the close-contact portion rotating shaft penetrating the side grip.

2. The vibro-hammer having a side grip of claim 1, wherein the pair of arms includes a first arm of which one end is coupled to a cylinder fixed to the side clamp, and a second arm of which the gear arm formed one end meshes with the gear arm provided in the first arm to be gear-coupled to the gear arm, and when the first arm is rotated about the coupled rotating shaft by driving of the cylinder, the second arm is rotated in a direction opposite to the first arm through the gear-coupled gear arm and the first and second arm and are away from each other or close to each other.

3. The vibro-hammer having a side grip of claim 2, wherein the pair of arms is located on an upper side and a lower side of the gear box, and the cylinder is coupled to the arms located on the upper side and the lower side, the cylinder located on the upper side is provided on one side, the cylinder located on the lower side is provided on the lower side, and when the cylinders are driven, the cylinders intersect on a vertical line.

4. The vibro-hammer having a side grip of claim 1, wherein the close-contact portion includes a rotation portion which protrudes from a surface opposite to a close-contact surface which comes into close contact with the perforated pile, and the other end of the side grip includes the rotation portion moving groove into which the rotation portion is introduced and rotated and a close-contact portion rotating shaft which vertically penetrates the rotation portion introduced into the rotation portion moving groove and couples the side grip and the rotation portion to each other, and the close-contact portion rotates in a tangential direction with respect to the outer surface of the perforated pile about the close-contact portion rotating shaft and grips the perforated pile.

* * * * *